US007097502B2

(12) United States Patent
Landis et al.

(10) Patent No.: US 7,097,502 B2
(45) Date of Patent: Aug. 29, 2006

(54) TERMINAL BLOCK ASSEMBLY

(75) Inventors: John Michael Landis, Camp Hill, PA (US); David James Fabian, Mount Joy, PA (US); Ronald Martin Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 17 days.

(21) Appl. No.: 10/436,810

(22) Filed: May 13, 2003

(65) Prior Publication Data

US 2004/0229518 A1 Nov. 18, 2004

(51) Int. Cl.
*H01R 13/40* (2006.01)

(52) U.S. Cl. ..... 439/595; 439/709

(58) Field of Classification Search ..... 439/595, 439/709–722, 810–814, 780–793
See application file for complete search history.

(56) References Cited

U.S. PATENT DOCUMENTS

| | | | | | |
|---|---|---|---|---|---|
| 2,117,112 | A | * | 5/1938 | Buchanan | 439/793 |
| 2,145,556 | A | * | 1/1939 | Rypinski | 174/94 S |
| 2,158,003 | A | * | 5/1939 | Douglas | 439/723 |
| 2,257,317 | A | * | 9/1941 | Wade | 439/723 |
| 2,388,724 | A | * | 11/1945 | Cornella | 439/783 |
| 2,458,413 | A | * | 1/1949 | Pennell | 439/793 |
| 2,997,688 | A | | 8/1961 | Nielsen et al. | |
| 3,072,879 | A | | 1/1963 | Crowther | |
| 3,124,409 | A | | 3/1964 | Nisula | |
| 3,206,717 | A | * | 9/1965 | Brown et al. | 439/723 |
| 3,605,067 | A | | 9/1971 | Szabo et la. | |
| 4,033,663 | A | | 7/1977 | McCardell | |
| 4,220,384 | A | * | 9/1980 | Clark et al. | 439/595 |
| 4,236,778 | A | | 12/1980 | Hughes et al. | |
| 4,273,408 | A | | 6/1981 | Orr | |
| 4,343,529 | A | | 8/1982 | Reavis, Jr. et al. | |
| 4,603,376 | A | | 7/1986 | Maier | |
| 4,611,876 | A | | 9/1986 | Barrabes | |
| 4,684,191 | A | | 8/1987 | Feher et al. | |
| 4,714,434 | A | * | 12/1987 | Norden | 439/488 |
| 4,795,380 | A | | 1/1989 | Frantz | |
| 4,854,897 | A | | 8/1989 | Grobbel | |
| 5,137,476 | A | * | 8/1992 | Noble | 439/797 |
| 5,421,747 | A | | 6/1995 | Agnihotri et al. | |
| 5,580,286 | A | | 12/1996 | Kramer et al. | |
| 5,595,505 | A | | 1/1997 | Duke et al. | |
| 5,605,479 | A | | 2/1997 | Kramer et al. | |
| 5,632,656 | A | * | 5/1997 | Lo | 439/676 |
| 5,816,844 | A | * | 10/1998 | Perera | 439/416 |
| 6,036,542 | A | * | 3/2000 | Montague et al. | 439/595 |
| 6,129,595 | A | * | 10/2000 | Scanlon et al. | 439/716 |
| 6,176,747 | B1 | | 1/2001 | Rowe et al. | |
| 6,302,723 | B1 | | 10/2001 | Baum et al. | |
| 6,406,324 | B1 | | 6/2002 | Duesterhoeft et al. | |
| 6,497,592 | B1 | | 12/2002 | Beadle | |
| 6,612,878 | B1 | * | 9/2003 | Lias et al. | 439/709 |
| 6,916,213 | B1 | * | 7/2005 | Nyblin et al. | 439/709 |
| 2003/0134543 | A1 | * | 7/2003 | McCoy et al. | 439/709 |

* cited by examiner

*Primary Examiner*—Gary F. Paumen

(57) ABSTRACT

A terminal block assembly includes a housing having a base portion and partition walls extending from the base portion. The partition walls are spaced apart to define a cavity therebetween. The terminal block assembly further includes a terminal connector removably secured in the cavity between the partition walls. The terminal is configured to accept at least one of a bare wire and a contact attached to a wire. At least one of the partition walls includes a latch arm deflectable outward away from the cavity. The latch arm snappably retains the terminal connector within the cavity.

18 Claims, 5 Drawing Sheets

TERMINAL BLOCK ASSEMBLY

BACKGROUND OF THE INVENTION

The invention generally relates to an electrical terminal block assembly and more particularly to a terminal block assembly configured to receive multiple wire and contact arrangements.

A wide variety of terminal block assemblies exist for use today depending upon the environment and application for which it is intended. In some applications, multiple sets of wires within an end product are joined within the terminal block assembly to external power cords and building wire. Examples of this application may be found in households or in commercial environments, such as restaurants or other businesses that utilize equipment that has high power demands. An example of a household appliance or restaurant appliance that has a high power demand is an electrical range. The manner in which the power cords or building wire are connected within the terminal block assembly is somewhat dependent upon city, state and federal regulations related thereto. For example certain city regulations require particular types of contacts to be securely fixed to the end of power cords installed in the household or commercial building. In other locales, building wires may be dedicated lines with one end being directly connected to the household or building power source (e.g. circuit breaker), while the opposite end is terminated directly to the appliance. In these situations, the building wire are not terminated at the wall in the room at a receptacle, but instead extend into the room to be directly connected to the product. Alternatively, when the building wiring ends at a wall receptacle, a separate "pigtail" type premanufactured power cord may be used to connect the end product to the wall receptacle.

The power cords joined to the end product may have ends that are terminated in a variety of manners. The form of termination may depend upon the applicable codes and regulations. For example, in certain metropolitan areas, power cords are not permitted to be used in any form. Instead, the bare conductor of the building wire is required to be directly attached to the terminal block assembly within the end product. In other applications and/or metropolitan areas the power cord is required to include particular types of contacts on the outer ends, with such contacts satisfying certain electrical and mechanical standards. The shape and configuration of these contacts varies. One example of a contact used with power cords is a ring and tongue configuration in which a base portion of the contact is securely crimped to the conductor of the power cord, while the outer end of the contact includes a washer shaped portion with a hole therethrough.

Heretofore, terminal block assemblies have been developed to be joined with a particular type of contact or alternatively to be joined directly to the bare conductors of the power cord. Examples of such terminal block assemblies are found in U.S. Pat. Nos. 4,273,408 and 4,603,376. The '376 patent discloses a terminal assembly having an opening therethrough to receive the bare conductor of the power cord. A set screw is provided through one side of the opening and, when screwed in, securely retains the bare conductor within the opening of the terminal block assembly. The '408 patent discloses a terminal block assembly having upper and lower plate portions that are joined by a screw. The exposed conductor is sandwiched between the upper and lower plate portions as the screw is tightened within the terminal block assembly. However, the configuration described in the '376 and '408 patents are not well suited to retain power cords having contacts provided thereon such as the ring tongue type contact.

An alternative configuration for a terminal block assembly is disclosed in U.S. Pat. No. 4,236,778. The '778 patent illustrates a terminal block assembly that is configured to receive a power cord having a contact of the ring and tongue type mounted thereto. A terminal is provided with a planer plate portion that receives the ring shaped end portion of the ring and tongue contact. A screw is received through both to securely bind them to one another. However, the terminal block assembly of the '778 patent is not well suited to directly receive the exposed conductors of the power cord.

Consequently, conventional terminal block assemblies have somewhat dedicated applications. A need exists for a terminal block assembly having a more universal configuration.

Further, conventional terminal block assemblies may be difficult to manufacture and may potentially become disassembled over time. In general, conventional terminal block assemblies include a housing formed of an insulative material and shaped to provide one or more regions therein to receive conductive terminal block connectors. Each terminal block connector is configured to join a power line from the end product (e.g. electrical range) and a corresponding power cord from the household or building power source. Each terminal block connector is held within the insulated housing of the terminal block assembly through a separate fastening means, such as rivets, screws, and the like. During construction of the terminal block assembly, manufacturing time is required to rivet or otherwise secure the terminal block connector to the insulated housing. The rivets or other securing members also add to the overall costs of the terminal block assembly. In addition, over the life of the terminal block assembly, the fastening member used to retain the terminal block connectors within the insulated housing may become loose or completely disconnected. Consequently, a need exists for an improved mechanism for retaining the terminal block connectors within the housing of the terminal block assembly.

BRIEF DESCRIPTION OF THE INVENTION

According to an exemplary embodiment, a terminal block assembly is provided. The terminal block assembly includes a housing having a base portion and partition walls extending from the base portion. The partition walls are spaced apart to define a cavity therebetween. The terminal block assembly further includes a terminal connector removably secured in the cavity between the partition walls. The terminal is configured to accept at least one of a bare wire and a contact attached to a wire.

According to another exemplary embodiment, the terminal block assembly includes a housing having a base portion and partition walls extending from the base portion. The partition walls are spaced apart to define a cavity therebetween. The cavity has at least one open cavity end and an open cavity side opposite the base portion. A terminal connector is provided in the cavity. The terminal connector has a central cavity with an open terminal having an end aligned with the open cavity end. The open terminal end is configured to receive a bare wire. The terminal connector has a plate portion facing the open cavity side. The plate position is configured to receive a contact provided on a wire.

DETAILED DESCRIPTION OF THE INVENTION

Figure 1:
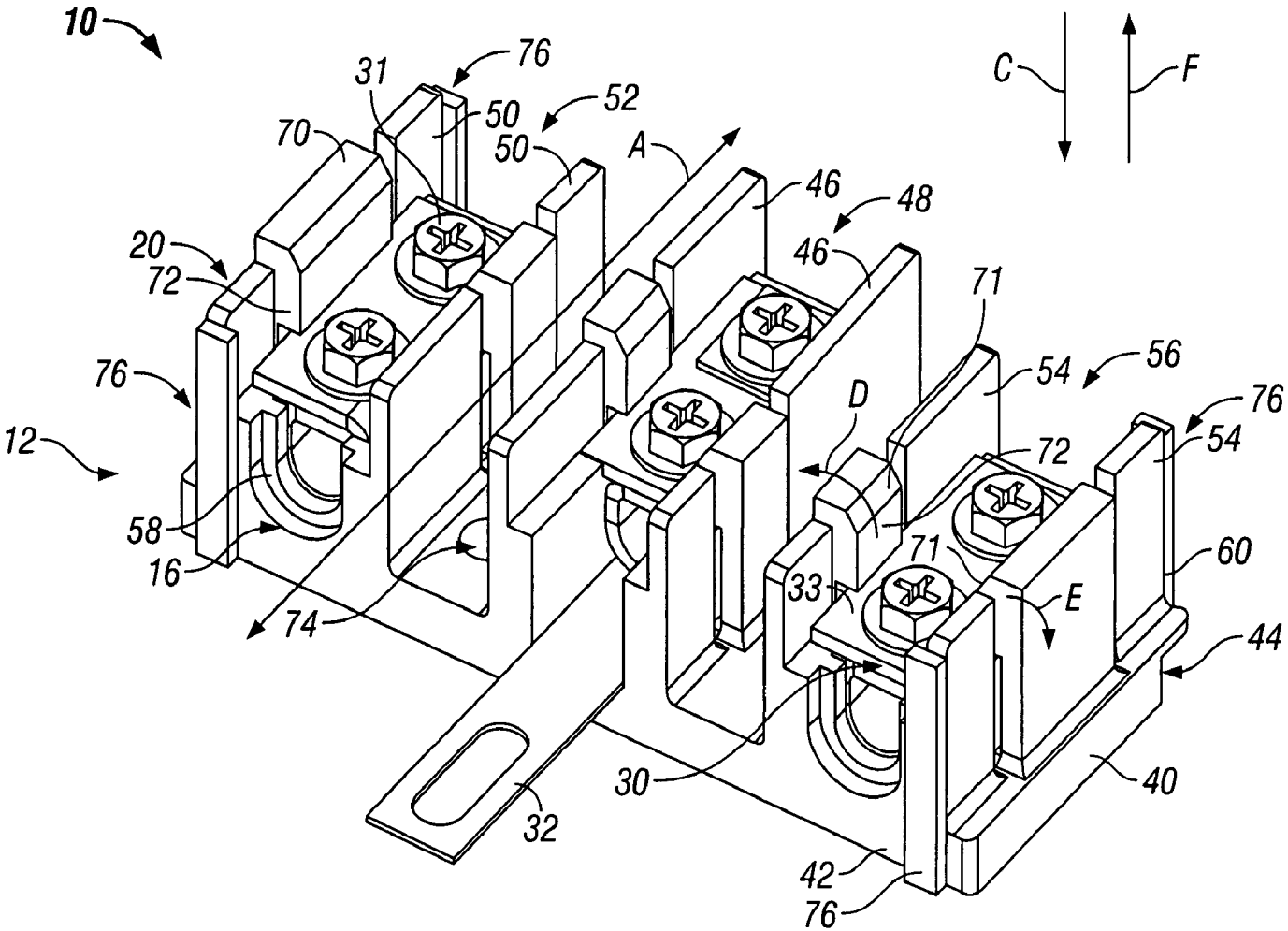
FIG. 1 is a perspective view of a terminal block assembly formed according to an embodiment of the present invention.
Figure 2:
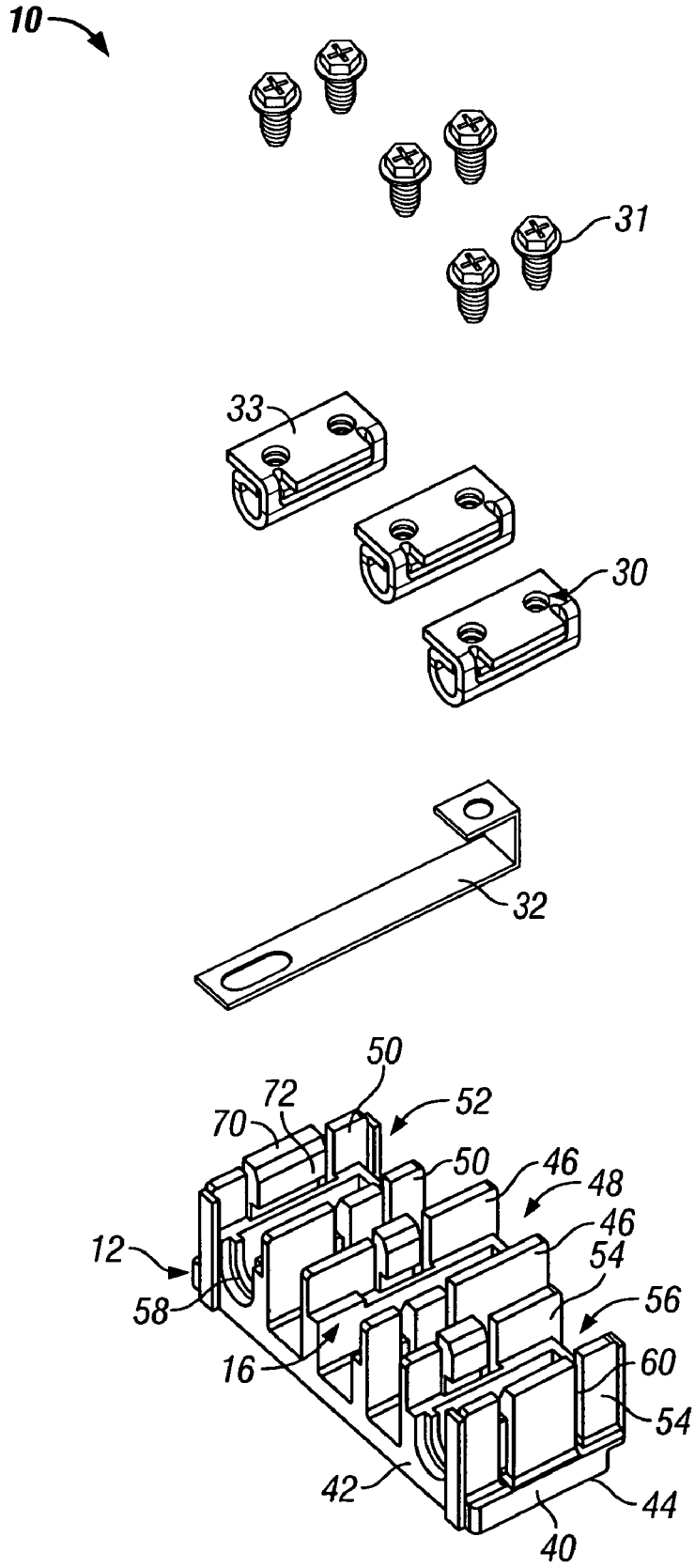
FIG. 2 is an exploded view of the terminal block assembly of FIG. 1.

FIG. 1 is a perspective view of a terminal block assembly 10 formed according to an embodiment of the present invention. FIG. 2 is an exploded view of terminal block assembly 10. Terminal block assembly 10 includes a housing 12 formed of any suitable insulating material possessing the requisite characteristics of strength, limited flexibility, moldability and high temperature tolerances. The housing 12 has a plurality of cavities 16 defined by partition walls 20. The cavities 16 are each adapted to receive at least one terminal connector 30. Terminal connector 30 includes at least one fastener, such as a screw 31. The terminal block assembly 10 also includes a ground strap 32 secured at one end between at least one of terminal connectors 30 and housing 12.

Housing 12 has a base portion 40, a first side 42 and a second side 44. Partition walls 20 extend upward from the base portion 40 of housing 12. Partition walls 20 are spaced apart so that each cavity 16 has a width slightly greater than a width of the corresponding terminal connector 30. The cavities 16 are open at opposite ends to permit insertion of electrical wires in either direction along path A that is generally parallel to the length of partition walls 20. A first pair of partition walls 46 are substantially parallel to each other and define a first cavity 48 therebetween. A second pair of partition walls 50 are substantially parallel to each other and define a second cavity 52 therebetween. A third pair of partition walls 54 are substantially parallel to each other and define a third cavity 56 therebetween. As shown in FIG. 1, the first, second and third cavities 48, 52 and 56 are arranged side by side and are oriented substantially parallel to each other. Optionally, first cavity 48 may be staggered or offset from first side 42 of housing 12 with respect to second and third cavities 52 and 56. Partition walls 20 preferably extended upward above the terminal connectors 30 such that each terminal connector 30 is fully recessed within its respective cavity 16. As shown in FIG. 2, the first side 42 of housing 12 has end walls 58 partially covering ends of the cavities 16. Optionally, second side 44 of housing 12 has end walls 60 partially covering ends of the cavities 16. Each wall 58 prevents a corresponding terminal connector 30 from sliding out of or being dislodged from its respective cavity 16. Partition walls 20 provide an insulation barrier between adjacent terminal connectors 30 and protect a user from inadvertent contact with one terminal connector 30 when working on a neighboring terminal connector 30.

In an exemplary embodiment, partition walls 20 include latch arms 70 to releasably secure terminal connectors 30 within respective cavities 16. The latch arms 70 extend upward from base portion 40 of housing 12. Optionally, latch arms 70 are integrally formed with corresponding partition walls 20. Each latch arm 70 includes a raised boss 72 that extends inward into the cavity 16. A pair of bosses 72 face each other within each cavity 16. The bosses 72 snap over and retain a corresponding terminal connector 30 within the cavity 16 between associated and walls 58 and 60. The latch arms 70 are normally biased inward toward the associated cavity 16 in order that bosses 72 remain hooked over the top surface 33 of the terminal connector 30. Latch arms 70 allow terminal connectors 30 to be removably secured or "snapped" into the cavities 16.

Figure 3:
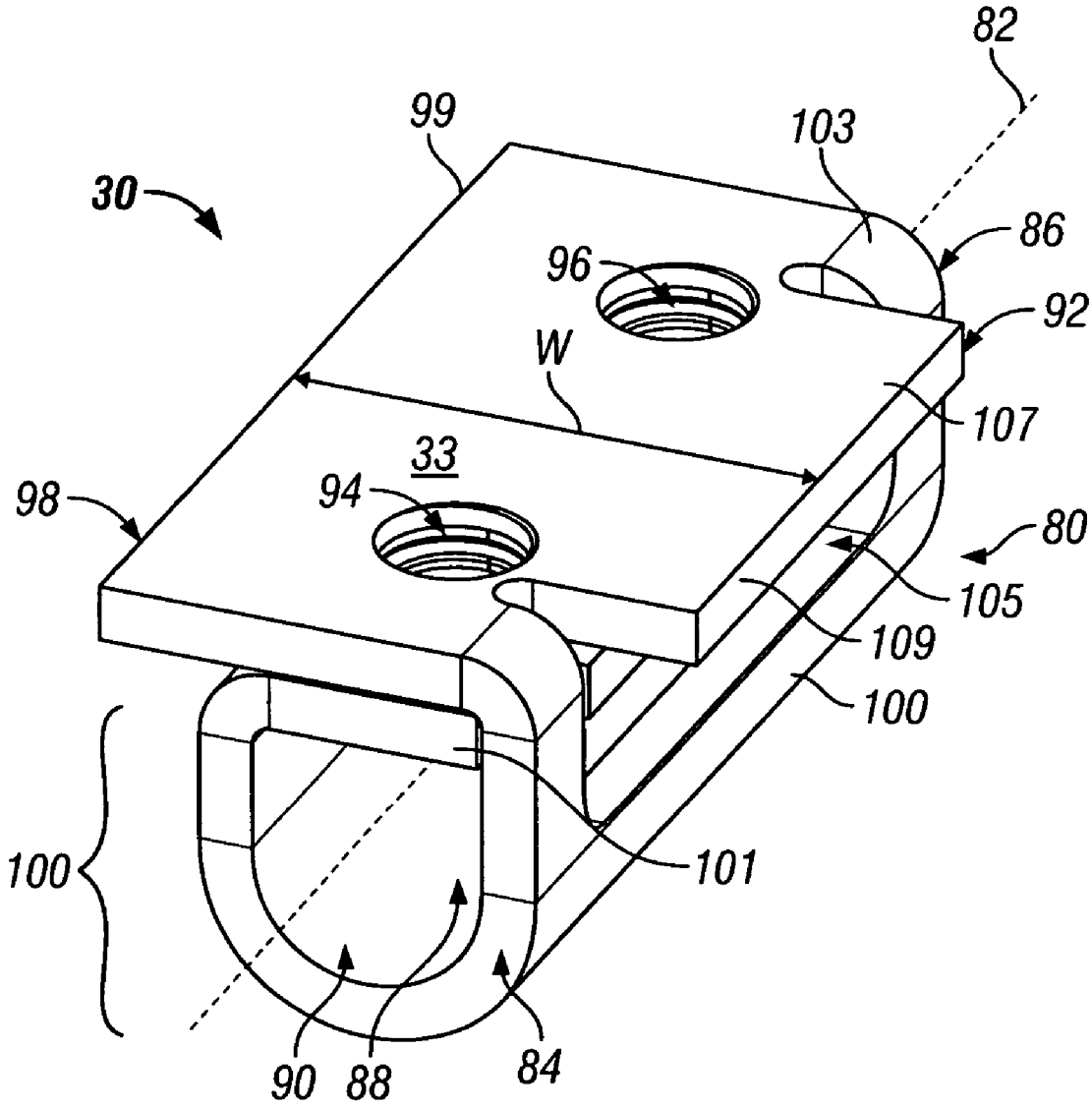
FIG. 3 is a perspective view of one embodiment of a terminal for use in the terminal block assembly of FIGS. 1 and 2.

Optionally, the housing 12 may have include corner posts 76 extending from base portion 40 of housing 12 and integral to partition walls 20 providing rigidity to the housing 12 and the partition walls 20. The corner posts 76 abut against terminal connector 30 to further resist twisting forces such as lateral, translational and rotational movement experienced by terminal connectors 30 to prevent terminal connectors 30 from dislodging from cavities 16. As illustrated, the partition walls 20 are generally rectangular. However, in alternative embodiments, the partition walls 20 may be shaped differently. Optionally, pairs of partition walls 46, 50 and 54 may be spaced apart from one another sufficiently to provide an area for a counter bore hole 74 therebetween. The hole 74 receives a fastener to secure housing 12 to an appliance, another product, or other structure:

FIG. 3 is a perspective view of terminal connector 30. Terminal connector 30 includes a terminal body 80 extending along a longitudinal axis 82 between a first terminal face 84 and second terminal face 86. Terminal connector 30 includes a central cavity 88 extending along the longitudinal axis 82 with openings 90 and 92 at the first and second terminal faces 84 and 86. Terminal connector 30 includes first and second threaded openings 94 and 96 that provide access to central cavity 88. First threaded opening 94 is proximate to the first terminal face 84, while the second threaded opening 96 is proximate to the second terminal face 86. As shown in FIG. 1, screws 31 are received in the first and second threaded openings 94 and 96.

In an exemplary embodiment, terminal body 80 is formed from a single piece of conductive metal bent to form a plate portion 98 and a tubular portion 100. Plate portion 98 defines top surface 33 to be planar. Tubular portion 100 is arcuate and defines central cavity 88. The tubular portion 100 includes a flat upper lip 101 that overlaps and rests against the bottom of the plate portion 98. The plate portion 98 is joined to the tubular portion 100 at elbows 103. A v-shaped notch 105 is cut into the tubular portion 100 to enable a ledge section 107 to remain coplanar with and part of the plate portion 98. In one embodiment, terminal body 80 is block or T-shaped and formed from extruded aluminum.

Returning to FIGS. 1 and 2, during assembly, each terminal connector 30 is mounted or loaded within the corresponding cavity 16 by pressing the terminal connector 30 downward, along a terminal loading direction in the direction of arrow C (FIG. 1). Terminal connector 30 is configured to receive a wire along a wire insertion direction in the direction of arrow A, which is orthogonal to terminal loading direction. Each terminal connector 30 is aligned with the corresponding cavities 16 such that the first and second faces 84 and 86 (FIG. 3) fit between the end walls 58 and 60, respectively, of the corresponding cavity. As the terminal connector 30 is pressed into a corresponding cavities 16, a lower U shaped section of the tubular portion 100 may engage beveled surfaces 71 provided on facing sides of the bosses 72. As the terminal connector 30 is pressed past and between a corresponding pair of latch arms 70, the latch arms 70 are deflected outward in opposite directions as indicated by arrows D and E. The latch arms 70 deflect outward by a distance sufficient to permit the plate portion 98 to pass the bosses 72. Once opposed side edges 99 and 109 on the plate portion 98 pass the corresponding pair of bosses 72, the latch arms 70 return to their normal positions (as shown in FIG. 1). The latch arms 72 are formed to rest in a position at which the bosses 72 are spaced a distance apart from one another less than the width (FIG. 3) of the plate portion 98 extending between side edges 99 and 109. Once the side edges 99 and 109 pass the bosses 72, the latch arms 70 prevent the corresponding terminal connector 30 from being dislodged or removed from a corresponding cavity 16. More specifically, the latch arms 70 prevent removal of the terminal connector 30 in the direction of arrow F (FIG. 1). The end walls 58 and 60 prevent shifting or removal of the terminal connectors 30 from corresponding cavities 16 along the path A (FIG. 1). The partition walls 20 prevent rotation of the terminal connectors 30 within corresponding cavities 16.

Terminal block assembly 10 may be used with either or both bare wires or wires having contacts on the ends thereof. Examples of contacts include, but are not limited to ring tongue, open spade, clinch nut, "F" crimp, Faston tab and wire ferrule. Examples of the wiring include, but are not limited to building wire, cord set wire, stripped wire, or unstripped wire. The terminal connectors 30 are configured to be secured to any one of the aforementioned contacts. The contacts may be introduced from both or either of first and second sides 42 and 44. For example, a ring tongue contact is connectable to the top surface 33 of plate portion 98 by removing a corresponding screw 31, placing the ring tongued contact on the top surface 33 and screwing the screw 31 through the ring tongue contact to the plate portion 98. Each terminal connector 30 is able to accept at least two separate contact wires from opposite directions.

The first and second terminal face openings 84 and 86 are also adapted to accept the bare conductors of a wire. The bare conductors (not shown) are insertable into one or both of openings 90 and 92 (FIG. 3) in the tubular portion 100 of terminal connector 30 and extends into central cavity 88. The bare wire may be secured by one or both screws extending within central cavity 88 through at least one of first and second threaded openings 94 and 96. Alternatively, the bare wire may be wrapped around the screw 31. By way of example, a wire terminated with a contact may be connected to terminal connector 30 on first terminal face 84 and a bare wire may be connected to second terminal face 86 of the same terminal connector 30. Alternatively, both wires with contacts and bare wires may be connected to terminals along first side 42 of housing 12 and/or second side 44 of housing 12.

Figure 4:
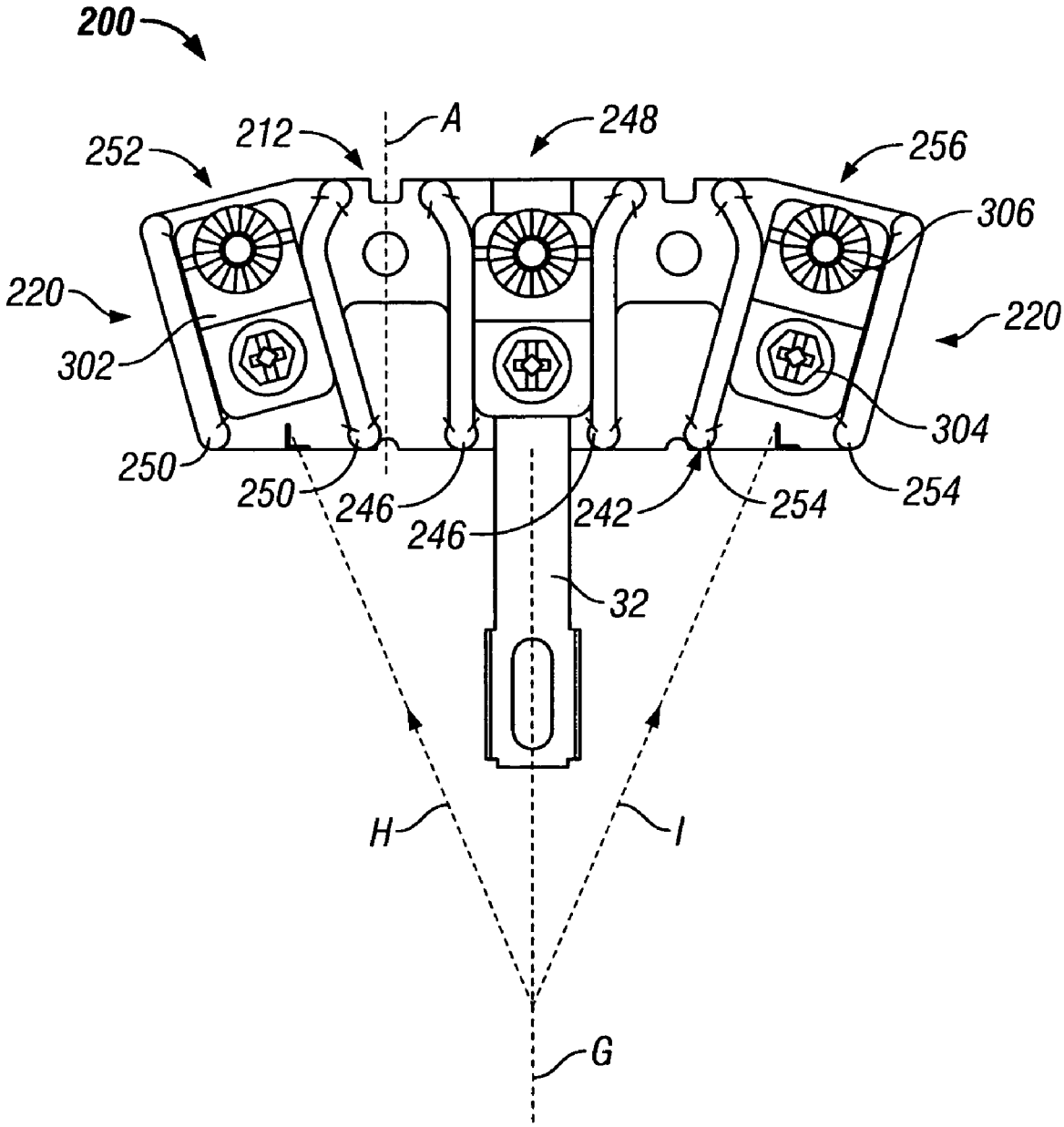
FIG. 4 is a top view of a terminal block assembly formed according to an embodiment of the present invention.

FIG. 4 is a top view of an alternative embodiment of a terminal block assembly 200 including a housing 212 with partition walls 220 forming a flared or sector pattern. As shown in FIG. 4, first pair of partition wall 246 is aligned along axis G. Second and third pairs of partition walls 250 and 254 are angled outwardly from first pair of partition walls 246 at acute angles H and I with respect to axis G. Thus, second and third cavities 252 and 256 permit insertion of electrical wires at a direction substantially non-parallel to direction A. Optionally, second and third pairs of partition walls 250 and 254 may be angled inwardly toward first pair of partition walls 246 with respect to first side 242 of housing 212. First, second, and third cavities 248, 252, and 256 receive an alternative embodiment of terminal connector 302. Terminal connector 302 has a screw 304 and is secured to housing 212 by a stud post 306.

The flared pattern for the housing 212 may be used with cord set wiring which typically has parallel wires that are crimped to ring tongue or open spade connectors. Cord set wires are fanned out before being attached to terminal connectors. The flared pattern shown in FIG. 4 positions second and third cavities 252 and 256 to accommodate the splay of wires from a jacketed cable or panel grommet.

Figure 5:
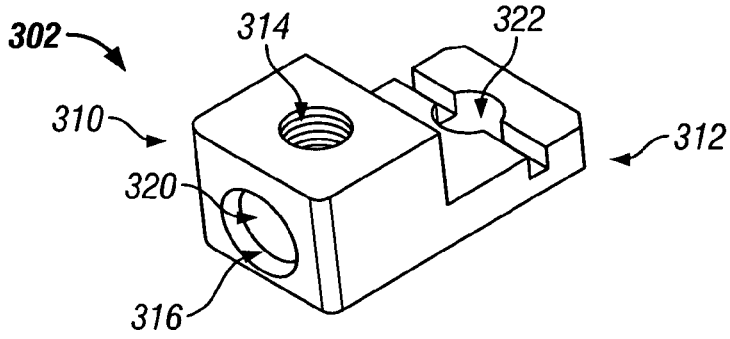
FIG. 5 is a perspective view of an alternative embodiment of a terminal for use with the terminal block assembly of FIG. 4.

FIG. 5 is a perspective view of an alternative embodiment of terminal connector 302. Terminal connector 302 has a wire connector portion 310 and a fastening portion 312. Wire connector portion 310 includes at least one threaded opening 314 for receiving screw 304 and a wire opening 316, whereby both threaded opening 314 and wire opening 316 provide access to a central cavity 320 within wire connector portion 310. Threaded opening 314 is substantially perpendicular to wire opening 316. Fastening portion 312 has a stud post opening 322 adapted to receive stud post 306 therethrough for securing terminal 302 to a housing (not shown). As in terminal connector 30 of FIG. 3, terminal connector 302 accepts both wire with contacts and bare wire. Threaded opening 314 and screw 304 accept wire with contacts and wire opening 316 accepts bare wire.

Figure 6:
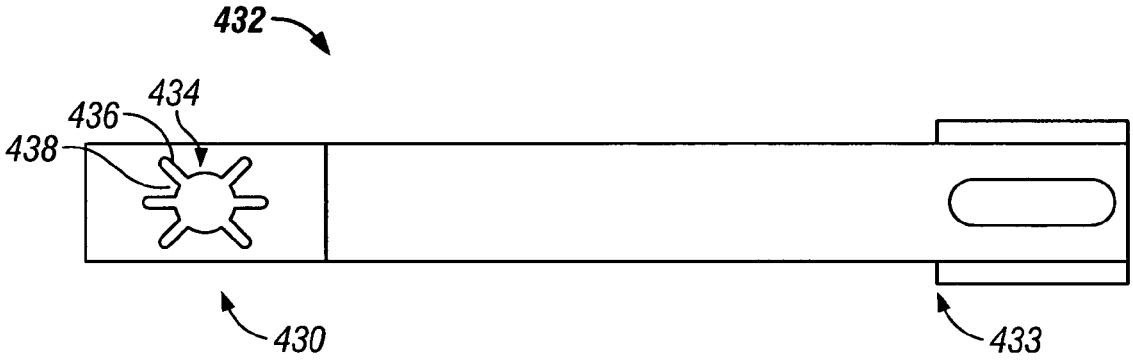
FIG. 6 is a top view of a ground strap for use with the terminal block assembly of FIG. 4.

FIG. 6 is a top view of an alternative embodiment of ground strap 432. Ground strap 432 includes a cantilever portion 430 and a electrical connection portion 433. Cantilever portion 430 includes an opening 434 having a plurality of radial beam openings 436 extending therefrom forming a plurality of beams 438. Cantilever portion 430 has a reduced thickness compared to electrical connection portion 433 to increase temper.

Figure 7:
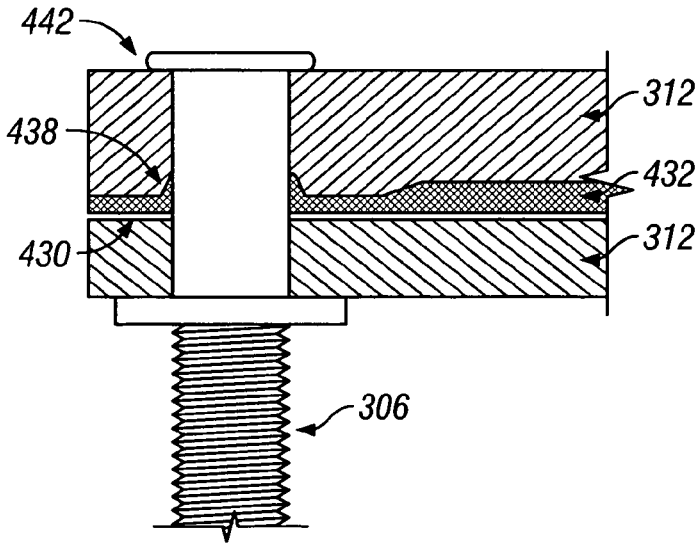
FIG. 7 is a partial side view of the terminal block assembly of FIG. 4.

FIG. 7 is a partial side view of ground strap 432 fixedly secured between fastening portion 312 of terminal 302 and housing 212 by stud post 306. Stud post 306 extends through fastening portion 312 of terminal 302, cantilever portion 430 of ground strap 432, and housing 212. Stud post 306 is peened on one end 442 thereby compressing terminal 302, ground strap 432 and housing 212 together and crimping beams 438 to stud post 306. Crimping beams 438 around stud post 306 provides further electrical integrity between ground strap 432 and stud post 306. Beams 438 provide enhanced electrical contact from ground strap 432 to stud post 306 after peening. The primary ground path is from ground strap 432 to terminal 302. Beams 438 provide secondary grounding if plastic creep occurs in housing 212 and primary ground resistance increases.

While the invention has been described in terms of various specific embodiments, those skilled in the art will recognize that the invention can be practiced with modification within the spirit and scope of the claims.

The invention claimed is:

1. A terminal block assembly comprising:

a housing having a base portion and partition walls extending from said base portion, said partition walls being spaced apart to define at least three cavities, each cavity having a cavity axis where each said cavity axis is flared in a non-parallel orientation to each other said cavity axis, and each cavity having first and second open cavity ends; and a terminal connector removably secured in each said cavity between said partition walls, said terminal connector having a central cavity with open terminal ends open to each of said first and second open cavity ends, each of said open terminal ends being configured to receive a bare wire, said terminal connector having a plate portion facing said central cavity side and having a fastener secured to said elate portion, said fastener and said plate portion being configured to secure there between a contact provided on a wire.

2. A terminal block assembly comprising:

a housing having a base portion and partition walls extending from said base portion, said partition walls being spaced apart to define a cavity therebetween; and a terminal connector removably secured in said cavity between said partition walls, said terminal connector includes a tubular portion extending between a first end and a second end of said terminal connector and defining a central cavity therebetween, said tubular portion formed integral with a plate portion, said tubular portion being received in said cavity, said tubular portion being configured to accept a bare wire at each of said first and second ends, and said plate portion having a fastener secured thereto, wherein said fastener and said plate portion being configured to secure therebetween a contact attached to a wire at each of said first and second ends.

3. A terminal block assembly comprising:

a housing having a base portion and partition walls extending from said base portion, said partition walls being spaced apart to define a cavity therebetween, said cavity having first and second open cavity ends and an open cavity side opposite said base portion; and a terminal connector provided in said cavity, said terminal connector having a central cavity with open terminal ends open to each of said first and second open cavity ends, each of said open terminal ends being configured to receive a bare wire, said terminal connector having a plate portion facing said open cavity side and having a fastener secured to said plate portion, said fastener and said plate portion being configured to secure there between a contact provided on a wire.

4. A terminal block assembly according to claim 3, wherein said partition walls extend parallel to one another along an entire length of opposite sides of said cavity to provide an insulation barrier.

5. A terminal block assembly according to claim 3, the contact has a planar surface, said housing further comprising a pair of movable latches on opposite sides of said cavity, said latches engaging said planar surface of the contact to securely retain the contact.

6. A terminal block assembly according to claim 3, wherein said partition walls include corner posts and latch arms extending from said base portion, said corner posts engaging said terminal connector to prevent said terminal connector from rotating relative to said base position, said latch arms being deflectable relative to said corner posts.

7. A terminal block assembly according to claim 3, wherein said base portion includes multiple sets of partition walls defining a plurality of cavities extending along parallel axes, said plurality of cavities securely retaining an equal plurality of terminal connectors.

8. A terminal block assembly according to claim 3, wherein said cavity extends along a terminal axis, said housing including end walls located at opposite ends of said cavity, said end walls abutting against opposite ends of said terminal connector to prevent translation of said terminal connector with respect to said housing.

9. A terminal block assembly according to claim 3, wherein said housing includes an open top side through which said terminal connector is loaded into said cavity along a terminal loading direction, said terminal connector being configured to receive a wire along a wire insertion direction that is orthogonal to said terminal loading directions.

10. A terminal block assembly according to claim 3, wherein said fastener extends into said central cavity to secure the bare wire to said terminal connector.

11. A terminal block assembly according to claim 3, wherein said fastener further comprises a screw extending through said plate portion into said central cavity of said terminal connector.

12. A terminal block assembly according to claim 3, wherein said terminal connector includes a tubular portion formed integral with and overlapping said plate portion, said tubular portion containing said central cavity.

13. A terminal block assembly according to claim 3, wherein at least one of said partition walls includes a latch arm deflectable outward away from said cavity, said latch arm snappably retaining said terminal connector within said cavity.

14. A terminal block assembly according to claim 3, further comprising a pair of movable latches on opposite sides of said cavity, said latches moving outward in opposite directions to accept said terminal connector therebetween.

15. A terminal block assembly according to claim 3, wherein said partition walls include corner posts extending from said base portion, said corner posts engaging said terminal connector to prevent said terminal connector from rotating relative to said base position.

16. A terminal block assembly according to claim 3, wherein said base portion includes multiple sets of partition walls defining a plurality of cavities extending along parallel axes.

17. A terminal block assembly according to claim 3, said central cavity of said terminal connector having a first open terminal end aligned with said first open cavity end and a second open terminal end aligned with said second open cavity end, each of said first and second open terminal ends being configured to receive a bare wire.

18. A terminal block assembly comprising:

a housing having a base portion and partition walls extending from said base portion, said partition walls being spaced apart to define a cavity therebetween, said cavity having first and second open cavity ends and an open cavity side opposite said base portion; and a terminal connector provided in said cavity, wherein said terminal connector includes a tubular portion joined to said plate portion, said tubular portion having a notch cut therein to provide a ledge portion aligned substantially planar with said plate portion, said terminal connector having a central cavity with an open terminal end aligned with either of said first and second open cavity ends, said open terminal end being configured to receive a bare wire, said plate portion facing said open cavity side and having a fastener secured to said plate portion, said fastener and said plate portion being configured to secure there between a contact provided on a wire.

* * * * *